US011439227B1

(12) United States Patent
Tham

(10) Patent No.: US 11,439,227 B1
(45) **Date of Patent: *Sep. 13, 2022**

(54) MODULAR TABLE AND ASSEMBLY

(71) Applicant: Noble House Home Furnishings, LLC, Chatsworth, CA (US)

(72) Inventor: Siew Kin Tham, Chatsworth, CA (US)

(73) Assignee: NOBLE HOUSE HOME FURNISHINGS, LLC, Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/119,897

(22) Filed: Dec. 11, 2020

Related U.S. Application Data

(63) Continuation of application No. 16/434,480, filed on Jun. 7, 2019, now Pat. No. 10,893,747, which is a continuation-in-part of application No. 16/361,581, filed on Mar. 22, 2019, now abandoned.

(60) Provisional application No. 62/668,756, filed on May 8, 2018, provisional application No. 62/646,833, filed on Mar. 22, 2018.

(51) Int. Cl.

| | |
|---|---|
| ***A47B 3/06*** | (2006.01) |
| ***A47B 13/00*** | (2006.01) |
| ***A47B 13/12*** | (2006.01) |
| ***A47B 13/06*** | (2006.01) |
| *A47B 31/00* | (2006.01) |

(52) U.S. Cl.
CPC ..... *A47B 3/06* (2013.01); *A47B 13/003* (2013.01); *A47B 13/06* (2013.01); *A47B 13/12* (2013.01); *A47B 2031/004* (2013.01); *A47B 2200/0011* (2013.01)

(58) Field of Classification Search
CPC ..... A47B 13/08; A47B 13/003; A47B 57/32; A47B 57/545; A47B 2220/0086
USPC ..... 108/157.18, 157.16, 157.15, 157.17, 108/158.13, 157.14, 153.1, 154, 157.1, 108/180
See application file for complete search history.

(56) References Cited

U.S. PATENT DOCUMENTS

| | | | | | |
|---|---|---|---|---|---|
| 880,525 | A * | 3/1908 | Hazzard | B25H 1/06 | 182/155 |
| 2,628,141 | A * | 2/1953 | Scheuer | A47F 5/0043 | 108/157.13 |
| 2,657,964 | A * | 11/1953 | Watrous | A47B 13/06 | 108/157.17 |

(Continued)

*Primary Examiner* — Jose V Chen
(74) *Attorney, Agent, or Firm* — Colin P. Abrahams

(57) ABSTRACT

A furniture item comprises first and second edge modules, each edge module having a substantially horizontal component with a receiving section and a substantially vertical component with a receiving section. The first and second edge modules are spaced and arranged with respect to each other so that the respective receiving section of the horizontal components face each other. A top surface is provided and has first and second ends. The first end is supported by the receiving section of the horizontal component of one first edge module and the second end is supported by the receiving section of the horizontal component of the second edge module. Further, there is a first leg having an upper section accommodated by the receiving section of the vertical component of the first edge module and a second leg having an upper section accommodated by the receiving section of the vertical component of the second edge module.

22 Claims, 5 Drawing Sheets

(56) References Cited

U.S. PATENT DOCUMENTS

| | | | | | |
|---|---|---|---|---|---|
| 2,829,934 | A * | 4/1958 | Heinrich | A47B 9/00 | 108/157.1 |
| 3,533,363 | A * | 10/1970 | Morris | A47B 3/12 | 108/153.1 |
| 3,669,033 | A * | 6/1972 | Murcia | A47B 47/04 | 108/180 |
| 4,242,969 | A * | 1/1981 | Checkwood | F16B 12/06 | 108/156 |
| 5,269,419 | A * | 12/1993 | Aldeguer | A47B 87/0223 | 108/180 |
| 5,483,900 | A * | 1/1996 | Elzenbeck | A47B 13/021 | 108/157.17 |
| 5,755,164 | A * | 5/1998 | Korte | A47B 87/002 | 108/157.18 |
| 5,865,129 | A * | 2/1999 | Samples | A47B 3/12 | 108/157.17 |
| 5,943,968 | A * | 8/1999 | Dobson | A47B 87/002 | 108/124 |
| 6,341,566 | B1 * | 1/2002 | Hwang | A47B 47/005 | 108/180 |
| 6,516,732 | B1 * | 2/2003 | LaCombe | A47B 45/00 | 108/153.1 |
| 6,766,748 | B2 * | 7/2004 | Insalaco | A47B 21/06 | 108/157.18 |
| 7,744,160 | B2 * | 6/2010 | Stolarov | A47B 96/202 | 297/440.12 |
| 8,079,315 | B2 * | 12/2011 | Berent | A47C 4/03 | 108/158.12 |
| 10,893,747 | B1 * | 1/2021 | Tham | A47B 13/12 | |
| 2003/0070590 | A1 * | 4/2003 | Weiss | A47B 85/00 | 108/26 |

* cited by examiner

MODULAR TABLE AND ASSEMBLY

CROSS-REFERENCE TO RELATED APPLICATIONS

This application is a continuation application of U.S. patent application Ser. No. 16/434,480 filed Jun. 7, 2019, which is a continuation in part application of U.S. patent application Ser. No. 16/361,581 filed Mar. 22, 2019, which claims the benefit of U.S. Provisional Patent Application No. 62/646,833 filed Mar. 22, 2018, and U.S. Provisional Patent Application No. 62/668,756 filed May 8, 2018, all of which are incorporated herein by reference in their entirety.

FIELD AND BACKGROUND OF THE INVENTION

This invention relates to a modular table and its assembly. Particularly, the invention may relate to a table which may be utilized, for example, as a coffee table or an end table, as well as the components thereof, and the assembly of the components into the usable product. The table of the invention may preferably be comprised mainly or principally of glass material, but the invention is not, however, limited to tables having such materials and construction.

Glass is a unique material which, when it comprises all or part of a piece of furniture, is functional and aesthetically pleasing, but is also capable of holding a sustaining product lifespan cycle. The utilization of glass as an item of furniture may require that it be specially treated such as by tempering, so that, if it should shatter or break, there will be no or a substantially reduced amount of shards or other dangerous byproducts of the breakage of glass produced as a result.

Furthermore, the use of glass as a component of furniture requires that it be packed according to very high standards for the purposes of shipping, storage and transportation, so that the product arrives at its destination in an undamaged and intact condition, ready for use and assembly by the end user thereof.

SUMMARY OF THE INVENTION

According to one aspect of the invention, there is provided a furniture item comprising: first and second edge modules, each edge module comprising a substantially horizontal component having a receiving section and a substantially vertical component having a receiving section, the first and second edge modules spaced and arranged with respect to each other so that the respective receiving section of the horizontal components face each other; a top surface having first and second ends, the first end being supported by the receiving section of the horizontal component of the first edge module and the second end being supported by the receiving section of the horizontal component of the second edge module; and a first leg having an upper section accommodated by the receiving section of the vertical component of the first edge module, and a second leg having an upper section accommodated by the receiving section of the vertical component of the second edge module.

Preferably, each edge module comprises an intermediate portion having a side portion and a base portion, the horizontal component extending from the side portion thereof and the vertical component extending from the base portion thereof. In one embodiment, the receiving section of the horizontal component comprises a rest surface for receiving the first or second end of the top surface, and the receiving section of the vertical component comprises an elongate slot for receiving the first or second leg.

The rest surface of the horizontal component may include a suction cup having an anchor connected to the rest surface and a suction area for releasably connecting to a first or second end of the top surface.

In one aspect, the furniture item further comprises a frame extending between the first and second edge modules, the frame constructed so as to provide additional strength and stability to the furniture item. Preferably, the frame comprises opposing end pieces each attached to a respective edge module, and crossbeams extending between the opposing end pieces. In one form, the crossbeams between the opposing end pieces are formed in an X shaped configuration.

The top surface, first leg and second leg, when disassembled, may fit within the first and second edge modules in a protected position for compacted storage and transportation.

Preferably, the first leg and the second leg are connected to the first edge module and second edge module respectively by at least one bolt, the bolt extending through predrilled and registering apertures in the first and second legs and the first and second modules respectively. Further, the first edge module and second edge module may be each connected to the frame to form a module frame assembly in the factory manufacturing process.

In one embodiment, the furniture item comprises the module frame assembly, the top surface comprised of glass contained within the module frame assembly, and the first leg and second leg contained within the module frame assembly to form a compacted disassembled unit.

Each of the first and second edge modules may further comprise an L-shaped bracket, the L-shaped bracket comprising a support flange portion for at least partially supporting the frame. Additionally, there may be a support bar associated with each of the first and second edge modules on the horizontal component thereof, the support bar attaching to the frame.

The furniture item may be formed as a coffee table, an end table, a desk, or such other item of furniture within the scope of the invention.

According to a further aspect of the invention, there is provided a method of making a furniture item comprising: providing first and second edge modules, each edge module comprising a substantially horizontal component having a receiving section and a substantially vertical component having a receiving section, spacing the first and second edge modules with respect to each other so that the respective receiving section of the horizontal components face each other; locating a top surface having first and second ends relative to the first and second edge modules, the first end being supported by the receiving section of the horizontal component of one first edge module and the second end being supported by the receiving section of the horizontal component of the second edge module; and inserting a first leg having an upper into the receiving section of the vertical component of the first edge module and inserting a second leg having an upper section into the receiving section of the vertical component of the second edge module to form a table.

The method may further comprise the step of inserting a stabilizing frame between the first and second edge modules to form a frame module assembly. The frame module assembly may receive within a space defined thereby the disassembled top surface and the disassembled first leg and second leg so as to conform a compact and transportable furniture item which can be simply assembled by the end-user.

In one embodiment, the first and second edge modules are connected to the top surface and first leg or second leg respectively by bolts through predrilled registering apertures are formed therein.

In view of the unique material characteristics of glass, particularly when used wholly or partly as an item of furniture, the invention provides an improved mechanism to make and finish categories of furniture comprising this material. This may be achieved by reengineering or redesigning or amending or treating the product so that it still retains all or most of its aesthetic appearance. Further, the product will preferably be configured so as to allow its packaging size to be reduced. This, in turn, will improve loadability characteristics and reduce storage footprint, as well freight and transportation costs. It may also reduce local domestic logistics costs in the United States in delivering the product from a warehouse to a home. Still further, proper packaging and containment within a carton or other storage device, preferably of standard available size, may facilitate a reduction in damage to the goods while being transported.

In all of the above, these aspects of the invention are preferably achieved while the product and its materials continue to retain their aesthetic and utilitarian appeal, as well as their safety features and technical functions.

In one aspect, the table or other furniture piece in accordance with the invention may be comprised of a connector member which connects to a horizontal element, such as a glass (or other material) table surface, as well as to a vertical element, such as sheet glass (or other material) legs. Two such connector members may be used for a table in accordance with the invention, with each of such connectors being located at an opposite end or edge of the horizontal glass element. The connector member may have a lengthwise slot in a vertical orientation for the purposes of receiving and engaging the vertical element legs of the table. Any glass materials used in the composition of the table or other item of furniture, with the used in whole or in part, would preferably be tempered for safety so as to minimize or obviate any injuries in the event of breakage of the class. In this embodiment, the horizontal element forms the tabletop, and may rest on a ledge specially designed therefor on the connector member. Such ledges, which may be rabbet ledges, receive the glass top or other type of horizontal element. There is one such ledge on each of the connector pieces on each side of the horizontal member, and suction cups may be located thereon in a pre-attached manner on the ledge so that the glass top will be held in position without sliding around in the normal course.

Preferably, the item of furniture of the invention further comprises a stabilizing component, which may extend between the connector members on each side of the item of furniture. The stabilizing component may comprise a pair of opposing end pieces, and one or more posts or intermediate pieces between the opposing end pieces. The posts or intermediate pieces may be in the form of an X, or such other selected configuration which may best achieve its purpose of preventing instability or wobbling of the item of furniture once assembled.

The invention is thus for a furniture piece which preferably joins together in a modular fashion several pieces of sheet glass (or other material), but can be assembled and disassembled respectively from or to a knockdown table convenient for storage and shipping purposes. The invention is comprised of two connector member pieces, comprised of selected materials, such as wood, plastics, metal, synthetics to name some examples, or a combination thereof, and three pieces of sheet glass. Two of such sheet glass pieces connect to the connector member in a substantially vertical manner, and are received in dedicated slots or grooves therein in which they are securely held. A further sheet glass piece comprises the table top, and also connects to the connector member, one on each opposing side, being received and held thereon by appropriately configured ledges, substrates, cantilevers, suction cups and other structures. The invention may further comprise a frame or stabilizer, which may be comprised of metal or partial of metal, which connects to the two glass vertical members, spanning the distance between the connector members and thus providing additional stabilization to the assembled structure.

It is to be noted that, instead of using three sheets of glass as described above, only the tabletop section need be glass, and the vertical sections or legs may be comprised in whole or in part of another material. Further, the tabletop section may be other than glass, in whole or in part, and the legs or vertical sections may be glass, in whole or in part. In yet another configuration, the horizontal tabletop and the vertical side walls are comprised of materials other than glass, including a combination of other materials.

Thus, each connector member is designed with two joints or connecting areas. The first connects to vertical legs, which may be glass sheets, and the second connects to the horizontal table top, which may also be comprised of a glass sheet. The connecting areas may only be as large as necessary to provide a suitable and secure connection point, support and stabilization, so that the overall appearance and aesthetic of the assembled furniture piece is provided predominantly by the horizontal and vertical members. However, it is within the scope of the invention that the connector piece is also constructed so as to have a pleasing aesthetic appearance, integrated into and enhancing the look of the furniture piece.

Preferably, the two joints or connecting areas are configured so that they are at approximately 90 degree with respect to each other, so that, when assembled, the table top surface and the legs of the table will be positioned, also, at approximately 90 degrees. However, other angles and configurations may be used in accordance with the invention.

In one preferred embodiment of the invention, the tabletop glass sheet, while resting on the ledge, is held in position and prevented from moving or shifting in the normal course, by one or more suction cups fixed to the ledge, and which engage the underside of the tabletop glass sheet. While the suction cups prevent against moderate attempts to move the tabletop, the tabletop can, of course, be disengaged from the suction cups during any disassembly procedure. Further, other hardware for securing, at least temporarily while assembled, the tabletop glass sheets to the connector members may be used, including brackets, bolts, Velcro, clasps, to name a few non-limiting possibilities.

While certain structures and connection types are described and illustrated herein, it should be appreciated that the invention is not limited thereto. Any suitable form of connection which facilitates the stable fastening of horizontal and vertical pieces respectively to a connector means which fastens to both of these components may be used. One important advantage is to provide a modular furniture item with a knockdown option, wherein the various components can be boxed and packed in a protective and safe manner within a container so as to preserve the item, prevent breakage, and minimize any damage to any one component during transportation of the device within the container.

In one embodiment, the connector piece may have a rounded or contoured surface, and the grooves and ledges are created and cut to exacting standards so that the depth and configuration of these structures ensure that the assembled product has a quality fit and finish, and, further, is stable and secure. A tool may be provided as part of the modular kit to facilitate connection and assembly, such as for use in the tightening of nuts to bolts which help to keep the assembled item stable and secure.

DETAILED DESCRIPTION OF THE DRAWINGS

Figure 1:
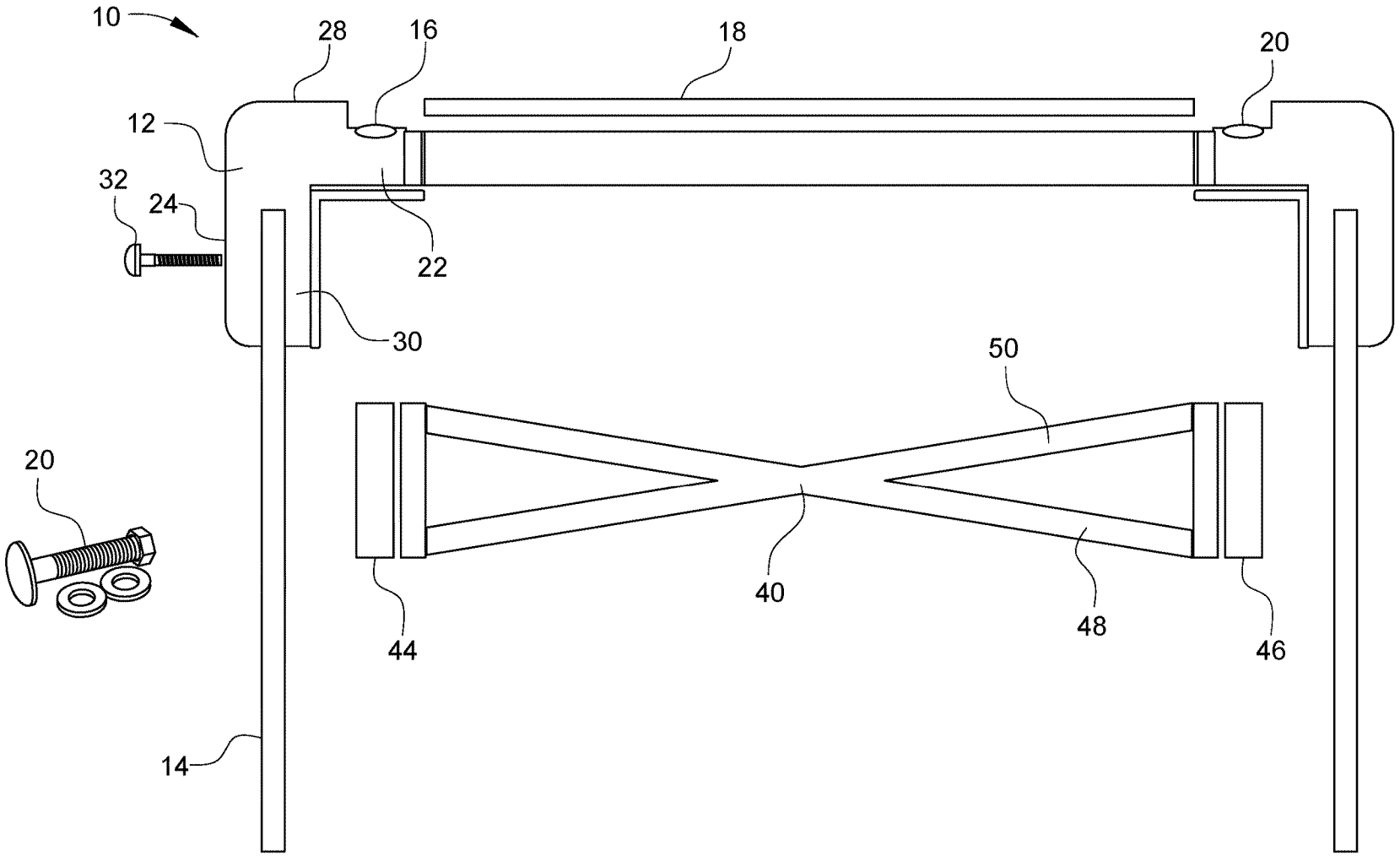
FIG. 1 is a schematic representation of a table having parts and components and constructed in accordance with one aspect of the present invention.

Reference is made to the accompanying figures of the drawings which shows, in various schematic views, an item of furniture in accordance with one aspect of the invention. In these figures, there is shown, for example, a coffee table 10, comprising a pair of corner or edge modules 12, the corner or edge modules 12 supporting in a vertical orientation a pair of leg panels 14. Each of the two corner or edge modules 12, respectively, receives and supports either the left leg panel 14 or the right leg panel 14, as shown. In one embodiment, these leg panels 14 are comprised of tempered glass, and may have a thickness of approximately 12 mm. The left leg 14 and right leg panels 14 may, moreover, be comprised of a material other than glass, including wood, laminate, metal, plastics, to name some examples only.

Each corner module 12 also has a ledge 16, such as a rabbet cut ledge, for receiving a horizontal tempered glass top 18, as illustrated. In a preferred embodiment, the glass top 18 may have a thickness of approximately 8 mm. The ledge 16 may include one or more suction cups 20 which engage and hold the glass top 18 in position so that it does not shift or slide during its normal functions and uses.

It will be seen that each corner or edge module 12, which may essentially comprise the same structure, has a horizontal section 22 and a vertical section 24. The horizontal section 22 has an upper edge which comprises the ledge 16. The horizontal section 22 defines a step, and the glass top 18 is preferably flush with the upper surface 28 of the corner or edge module 12 when the table 10 is in the assembled position.

The vertical section 24 of the corner or edge modules 12 includes a slot 30, open at the lower end, and configured so as to receive a portion of the leg panels 14. The leg panels 14 are inserted into the corner or edge module 12 through the slot 30. The leg panels 14 may be fixed in the slot by one or more bolts extending through predrilled holes in the vertical section 24, which match with predrilled holes in the leg panel 14 so that the to register and can receive one or more bolts 32 so as to secure these components together.

In order to further stabilize and secure the item of furniture so that it is firm and does not wobble or move once installed and assembled, a securing frame 40 may be provided. In the figures, the securing frame 40 comprises a pair of end supports 44 and 46, and a pair of crossbeams 48 and 50 extending therebetween, providing the additional stability. This arrangement comprises an X-frame type structure, which forms a main or principal rung to keep the table from collapsing or wobbling from side to side. In accordance with one embodiment of the invention, this X frame may be pre-welded or otherwise connected to the to support bars or corner modules. In another embodiment of the invention, the X-frame itself is pre-welded, but not pre-welded to the support bars or other components of the item of furniture. It may be bolted or otherwise fastened. In one example, the connector may be preset with embedded insert nuts. The pre-welded X-frame may then be attached to the connector by means of bolts. While the connector can be made of steel, stainless steel or aluminum, this may be fairly expensive, and it may, in a preferred embodiment thus be comprised of MDF. It is not necessary that the securing frame have this X-shape structure, and any shape which helps to achieve the purpose of providing stability to the table would fall within the scope of this invention.

The top row illustrated in the figures, comprising the upper portion of the corner modules and the securing frame, are connected to each other by, preferably, the three bolts. Preferably, these are factory installed so that each of the corner modules is respectively attached to the securing frame during the manufacturing process, and thus preassembled for shipping and transportation. These components, namely, the securing frame and the corner modules which are attached, preferably form the main pillar of support for the entire table. They extend completely through each of the corner modules so as to engage the securing frame.

The tempered glass top is located above the securing frame, resting on the ledge. Note that the securing frame, having its "X"-shaped configuration, as shown in FIG. 1 from above, does not detract significantly from the glass view transparency, thereby allowing light and viewing capability to extend therethrough.

A bottom row of bolts is provided, preferably in the form of three bolts, to lock the flat shaped first and second leg panels 14 into the groove or slots 30 of the corner module 12. The bolts will extend through the corner module 12 as well as a pre-drilled hole in the tempered glass leg panel 14. Preferably, the bolts used have a rounded finish and will be substantially flush at the surface of the corner module, and may even serve as a decorative or ornamental feature. Further, studs which act as decorative features may be Incorporated into the item of furniture.

Figure 2:
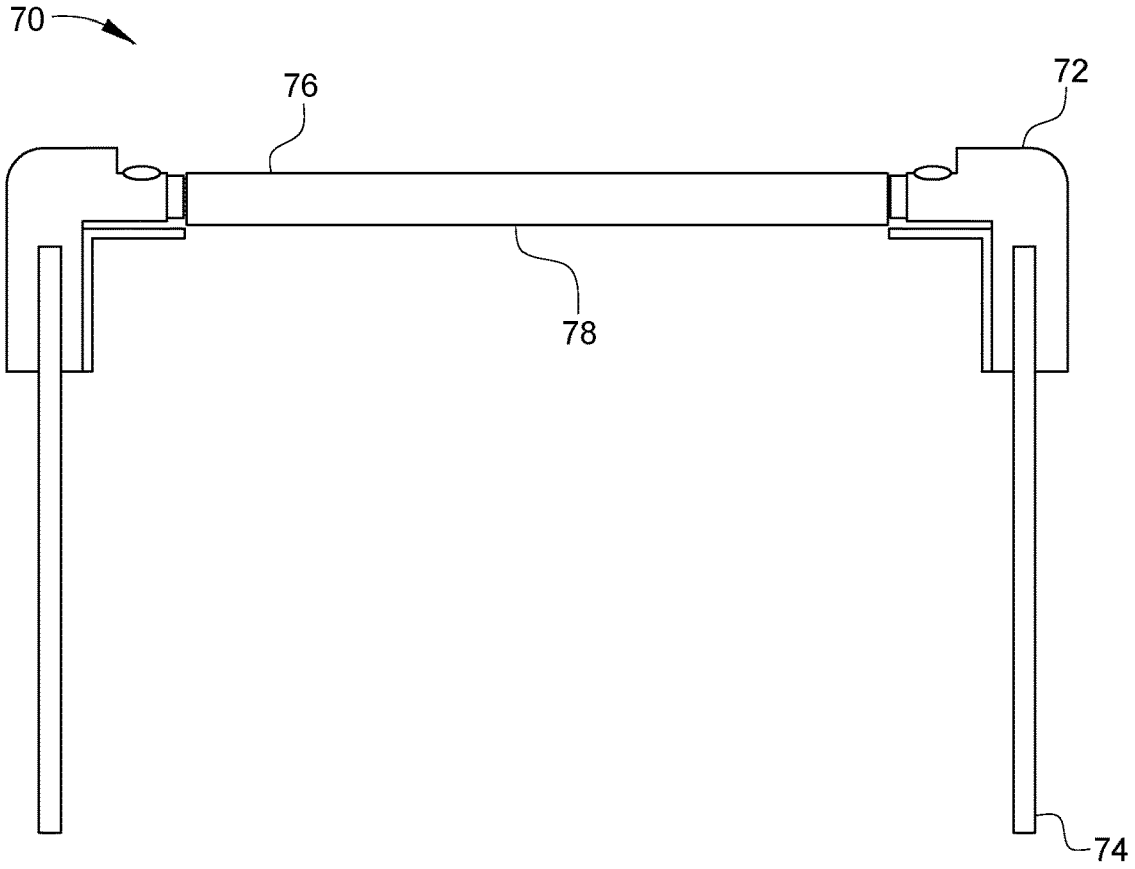
FIG. 2 is a front view of a coffee table or desk in accordance with the present invention.
Figure 3:
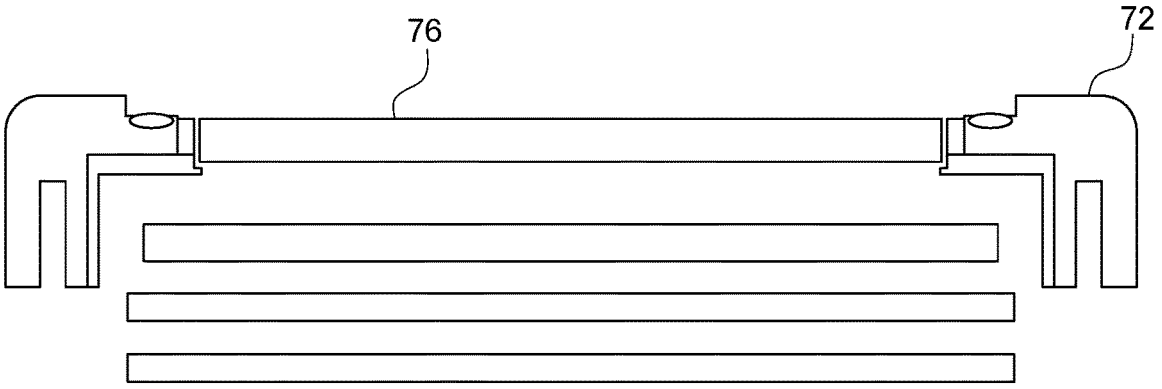
FIG. 3 is a view of the coffee table or desk shown in FIG. 2, disassembled and compacted for transportation and storage.

FIGS. 2 to 7 of the drawings show illustrations of the furniture item of the invention configured as different types of furniture which may be constructed in accordance with the invention. Some conventional coffee tables comprise a glass top and sides, all manufactured in one piece. The structure of the of such a table does not facilitate the ability to be disassembled or broken down for transportation. In FIGS. 2 and 3 of the drawings, there is shown a schematic representation of a coffee table 70 in accordance with the invention, generally as described above. The edge pieces 72 form as connectors for the glass vertical legs 74, as well as the glass top 76. The securing frame 78 is also bolted in place. In FIG. 3 of the drawings, it will be seen that the coffee table 70 in accordance with the invention may be disassembled or knockdown so that there is the single top component comprising the edge pieces 72, with only the securing frame 78 therebetween. The glass top 76, and glass side legs 74, are removed, by on fostering and storing the bolts, if necessary, and packed within a space created by the above structure, and conveniently broken down for storage and transportation. The coffee table 70 can thus be disassembled, cutting back on load and packaging costs, and thereby create the ability for more competitive pricing.

Assembly of the broken down product can be fairly easily accomplished by the end-user, by simply installing the table top 76 and side legs 74 in the appropriate grooves and on the ledges. However, in its compacted form, the various components forming the table can be packed in a manner which is safe and secure to avoid breakage or damage of any of the components, especially the glass components (where these are used) which are more susceptible to breakage due to their brittleness.

Figure 4:
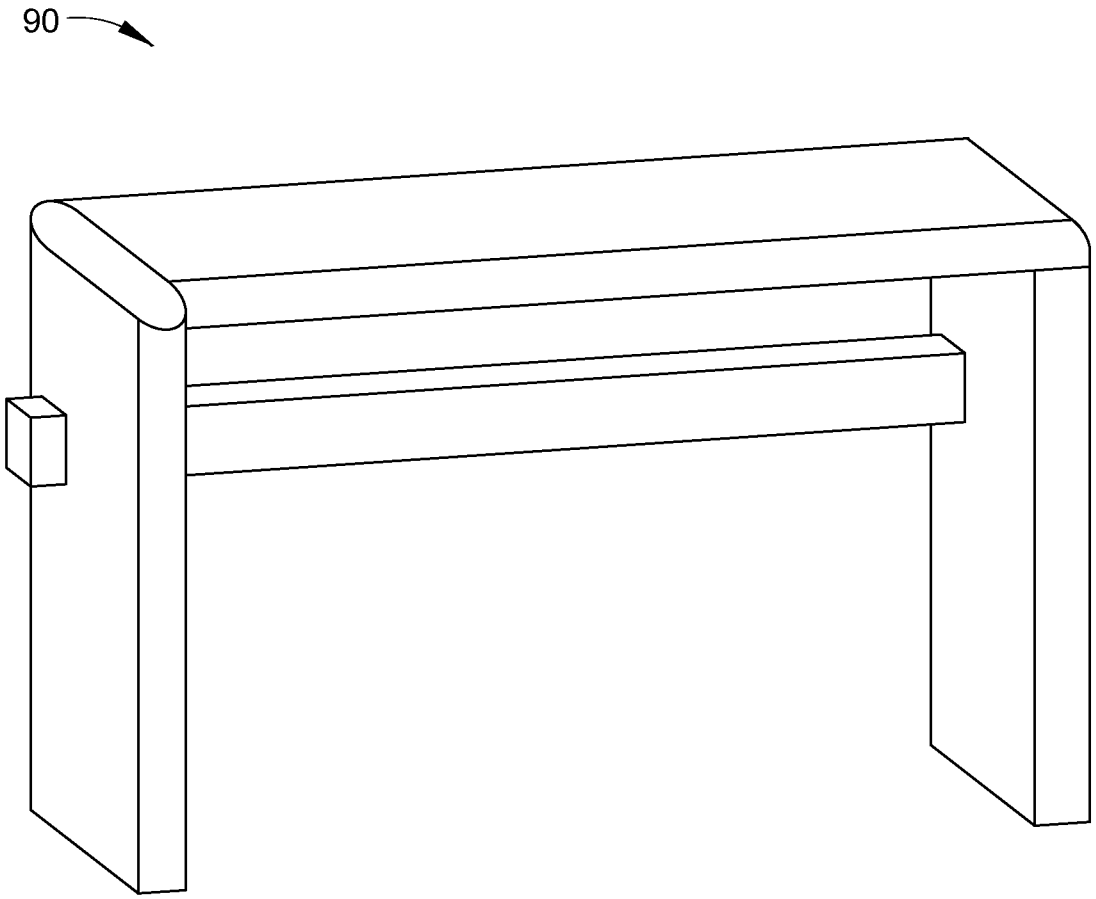
FIG. 4 is a perspective view of an end table in accordance with the present invention.
Figure 5:
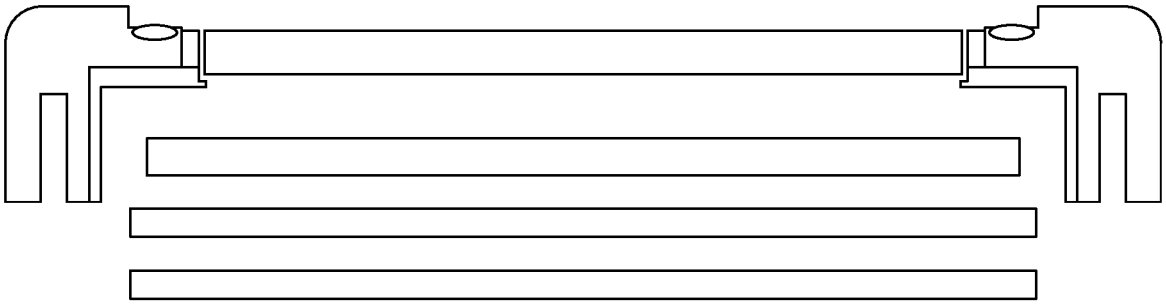
FIG. 5 is a front view of the end table shown in FIG. 4, disassembled and ready for package for transportation and storage.

In FIGS. 4 and 5 of the drawings, there is shown an end table 90, pre-constructed. With the invention, in one style as shown in FIG. 4, a comparable partly glass structure is created with a curved joint and a wood component extending between the legs to provide stability. In another style, shown in FIG. 5, another embodiment is shown, but without curved joints and with a glass panel to hold the table and provide stability against wobbling. FIG. 5 also shows how the components of the invention can be broken down and stored, in a protective, safe and compact manner, in order to reduce load and transport costs. The storage configuration for all of the different styles and types of tables may essentially be very similar or the same.

Figure 6:
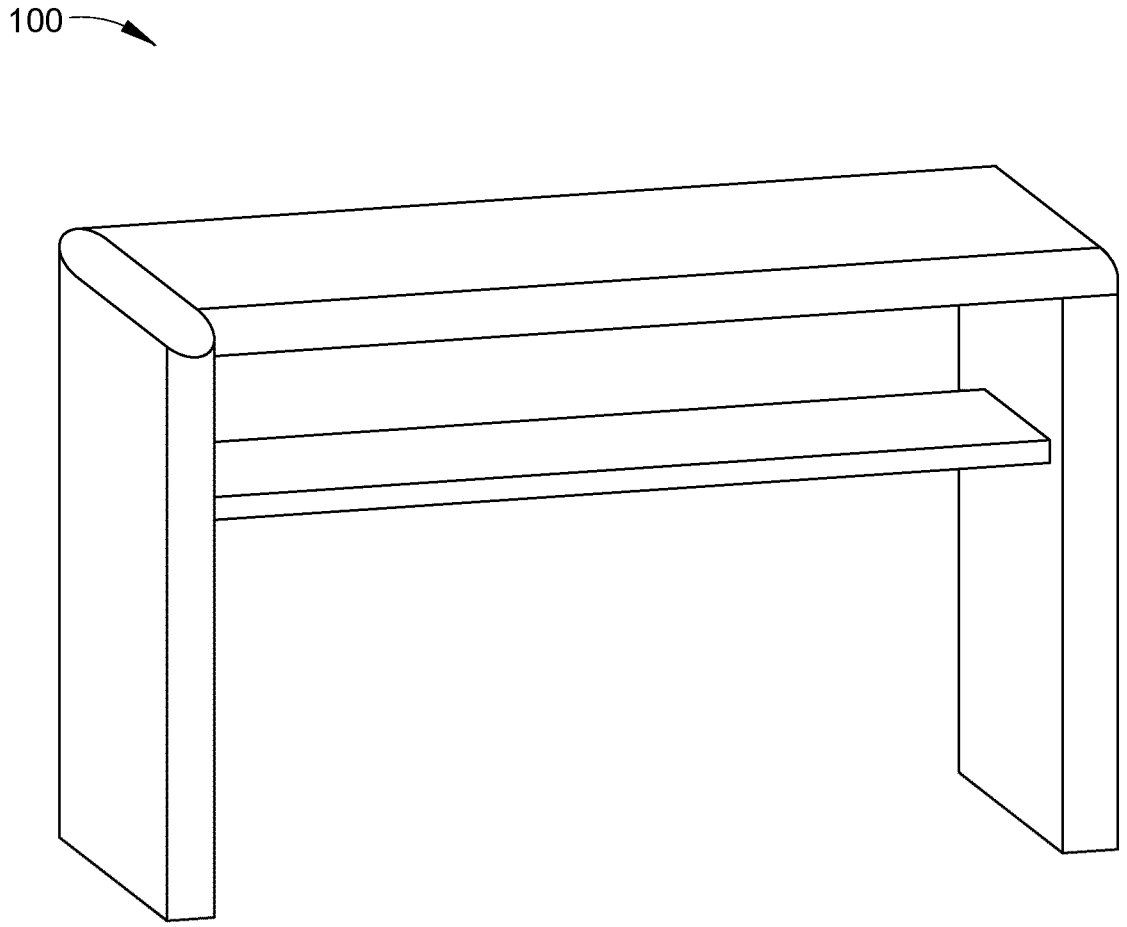
FIG. 6 is a perspective view of a coffee table in accordance with the present invention.
Figure 7:
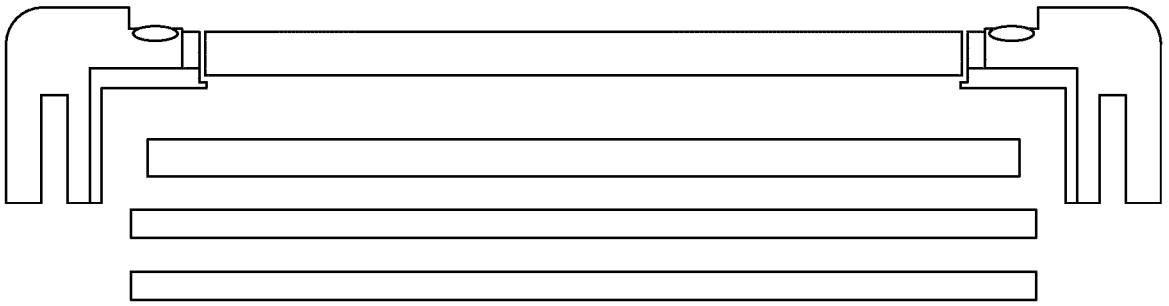
FIG. 7 is a front view of the coffee table shown in FIG. 6, disassembled and ready for package for transportation and storage.

In FIGS. 6 and 7 of the drawings, there is shown a further embodiment of a coffee table 100. In one of the styles, a coffee table with glass leg panels and a table top comprised of tempered glass is shown. A lower shelf is provided, which may be of a selected material, including a laminate. The column showing the packaging of this product is shown under the packaging column, once more compacted, making it easier and less expensive to transport.

Figure 8:
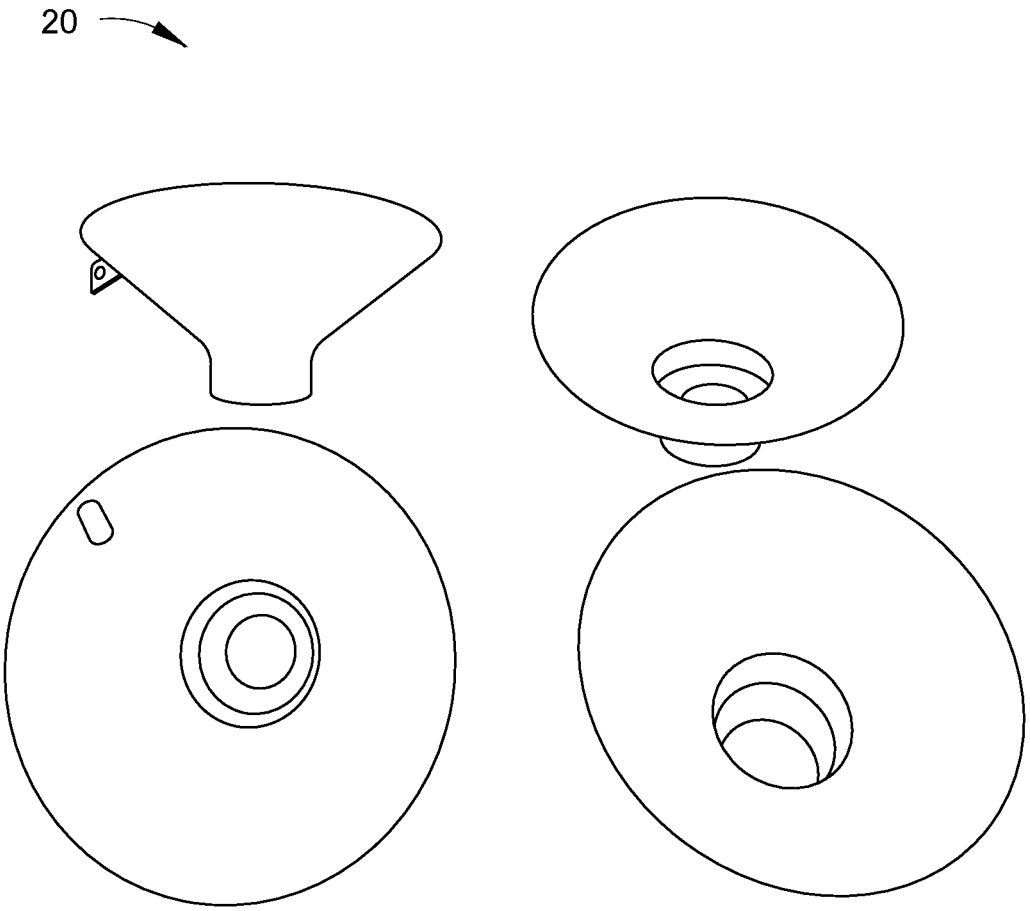
FIG. 8 is a detailed view showing suction cups which may be used in accordance with the invention in order to engage the glass or other surface to reduce slippage thereof in normal usage.

FIG. 8 of the drawings shows another embodiment of the invention wherein there is illustrated the use of the suction cup 20 to keep the glass table top in a relatively fixed and stable position. The suction cup may have, in one embodiment, a body portion which may be embedded or otherwise affixed in the securing frame, while the suction portion extends upwardly and can appropriately engage the glass top, in conventional fashion. The suction cup 20 may be fixed to the securing frame or other component in a releasable manner so that it can be removed and stored, or even replaced once it is become used and loses some of its effectiveness.

In accordance with the invention, there is therefore provided a furniture table, such as a coffee table or end table, having a pair of end pieces, each end piece having a support ledge and a slot or groove, a tabletop component releasably received and accommodated on the support ledge of each of the end pieces, and a pair of legs components each of which is received in the slot or groove of the end piece. Preferably, the tabletop and legs components are comprised of glass, preferably tempered glass, although this is not essential for the invention.

The invention may further comprise a securing member extending between the end pieces for providing additional stability to the furniture table.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A furniture item comprising:

first and second edge modules, each edge module comprising a first component having a receiving section and a second component having a receiving section, the first and second edge modules spaced and arranged with respect to each other so that the respective receiving section of the first components face each other;

a top surface having first and second ends, the first end being supported by the receiving section of the first component of the first edge module and the second end being supported by the receiving section of the first component of the second edge module;

a first leg having an upper section accommodated by the receiving section of the second component of the first edge module, and a second leg having an upper section accommodated by the receiving section of the second component of the second edge module; and a frame extending between the first and second edge modules and connecting the first and second edge modules to form a connected component.

2. A furniture item as claimed in claim 1 wherein each edge module comprises a third portion having a side portion and a base portion, the first component extending from the side portion thereof and the second component extending from the base portion thereof.

3. A furniture item as claimed in claim 2 wherein the receiving section of the first component comprises a rest surface for receiving the first or second end of the top surface, and the receiving section of the second component comprises an elongate slot for receiving the first or second leg.

4. A furniture item as claimed in claim 3 wherein the rest surface of the first component includes a suction cup having an anchor connected to the rest surface and a suction area for releasably connecting to a first or second end of the top surface.

5. A furniture item as claimed in claim 2 wherein the third portion has a rounded outside surface.

6. A furniture item as claimed in claim 1 wherein the frame extending between the first and second edge modules is constructed so as to provide additional strength and stability to the furniture item.

7. A furniture item as claimed in claim 6 wherein the frame comprises opposing end pieces each attached to a respective edge module, and crossbeams extending between the opposing end pieces.

8. A furniture item as claimed in claim 7, wherein the crossbeams between the opposing end pieces are formed in an X shaped configuration.

9. A furniture item as claimed in claim 6 wherein the first edge module and second edge module are each connected to the frame to form a module frame assembly in the factory manufacturing process.

10. A furniture item as claimed in claim 9 comprising the module frame assembly, the top surface comprised of glass contained within the module frame assembly, and the first leg and second leg contained within the module frame assembly to form a compacted disassembled unit.

11. A furniture item as claimed in claim 6 wherein each of the first and second edge modules further comprises an L-shaped bracket, the L-shaped bracket comprising a support flange portion for at least partially supporting the frame.

12. A furniture item as claimed in claim 6 further comprising a support bar associated with each of the first and second edge modules on the horizontal component thereof, the support bar attaching to the frame.

13. A furniture item as claimed in claim 1 wherein the top surface, first leg and second leg, when disassembled, fit within the first and second edge modules in a protected position for compacted storage and transportation.

14. A furniture item as claimed in claim 1 wherein the top surface comprises tempered glass.

15. A furniture item as claimed in claim 1 wherein the first leg and second leg are comprised of glass.

16. A furniture item as claimed in claim 1 wherein the first leg and the second leg are connected to the first edge module and second edge module respectively by at least one bolt, the bolt extending through predrilled and registering apertures in the first and second legs and the first and second modules respectively.

17. A furniture item as claimed in claim 1 wherein formed as a coffee table.

18. A furniture item as claimed in claim 1 when formed as an end table.

19. A method of making a furniture item comprising:

providing first and second edge modules, each edge module comprising a first component having a receiving section and a second component having a receiving section, spacing the first and second edge modules with respect to each other so that the respective receiving section of the first components face each other;

locating a top surface having first and second ends relative to the first and second edge modules, the first end being supported by the receiving section of the first component of one first edge module and the second end being supported by the receiving section of the first component of the second edge module; and inserting a first leg having an upper into the receiving section of the second component of the first edge module and inserting a second leg having an upper section into the receiving section of the second component of the second edge module to form a table; and locating a frame between the first and second edge modules and connecting the first and second edge modules to form a connected component.

20. A method as claimed in claim 19 further comprising the step of inserting a stabilizing frame between the first and second edge modules to form a frame module assembly.

21. A method as claimed in claim 20 wherein the frame module assembly receives within a space defined thereby the disassembled top surface and the disassembled first leg and second leg so as to conform a compact and transportable furniture item which can be simply assembled by the end-user.

22. A method as claimed in claim 20 wherein the first and second edge modules are connected to the top surface and first leg or second leg respectively by bolts through predrilled registering apertures are formed therein.

* * * * *